United States Patent [19]

Bemis

[11] 3,965,493

[45] June 29, 1976

[54] WATER CLOSET TANK

[75] Inventor: Richard A. Bemis, Sheboygan, Wis.

[73] Assignee: Bemis Manufacturing Company, Sheboygan, Wis.

[22] Filed: Mar. 12, 1975

[21] Appl. No.: 557,706

[52] U.S. Cl. ..... 4/18 R; 4/252 A; 4/68

[51] Int. Cl.[2] ..... E03D 1/20; E03D 11/00; E03D 1/01

[58] Field of Search ..... 4/18, 68, 252 R, 252 A, 4/1

[56] References Cited

UNITED STATES PATENTS

| | | | |
|---|---|---|---|
| 2,395,606 | 2/1946 | Zinkil | 4/68 |
| 2,942,275 | 6/1960 | Norman et al. | 4/18 |
| 3,135,968 | 6/1964 | Parrish | 4/18 |
| 3,435,101 | 3/1969 | Boorman | 4/18 |
| 3,491,380 | 1/1970 | Williams | 4/18 |
| 3,760,428 | 9/1973 | Korol | 4/18 |

*Primary Examiner*—Henry K. Artis
*Attorney, Agent, or Firm*—Fred Philpitt

[57] ABSTRACT

A replacement water closet tank for toilets, comprising, a tank means formed of a thin, rigid, high-impact strength plastic, including, a generally-rectangular, open-topped tank; a cover designed to overlap and fit flush with the exterior walls of the tank; interlock means, such as flat tabs formed on the interior of and parallel to the lower rim of the cover and spaced from the cover by perpendicularly-disposed flat spines to form generally T-shaped structures which fit into slots in the upper edge of the tank to clamp the upper edge of the tank between the overlapping portion of the cover and the tabs; and a generally-rectangular, thin, pliable plastic liner having overall dimensions sufficiently less than those of the tank to fit within the tank and form an air space between the tank and the liner and an upper rim extended outwardly a sufficient distance to contact the sides of the tank and be pressed against the tank to form an air-tight seal. The flush valve assembly and ball cock assembly are mounted through holes in the liner and holes in flat-topped inward depressions in the bottom of the tank and in a manner to bind the liner to the tank, and bolts, for mounting the tank on a toilet bowl are mounted through holes, drilled at the side, in selected ones of a plurality of inward depressions in the bottom of the tank, with the head of the bolt in sufficient proximity to the liner that flexing the liner downwardly will frictionally hold the bolt head during mounting.

15 Claims, 10 Drawing Figures

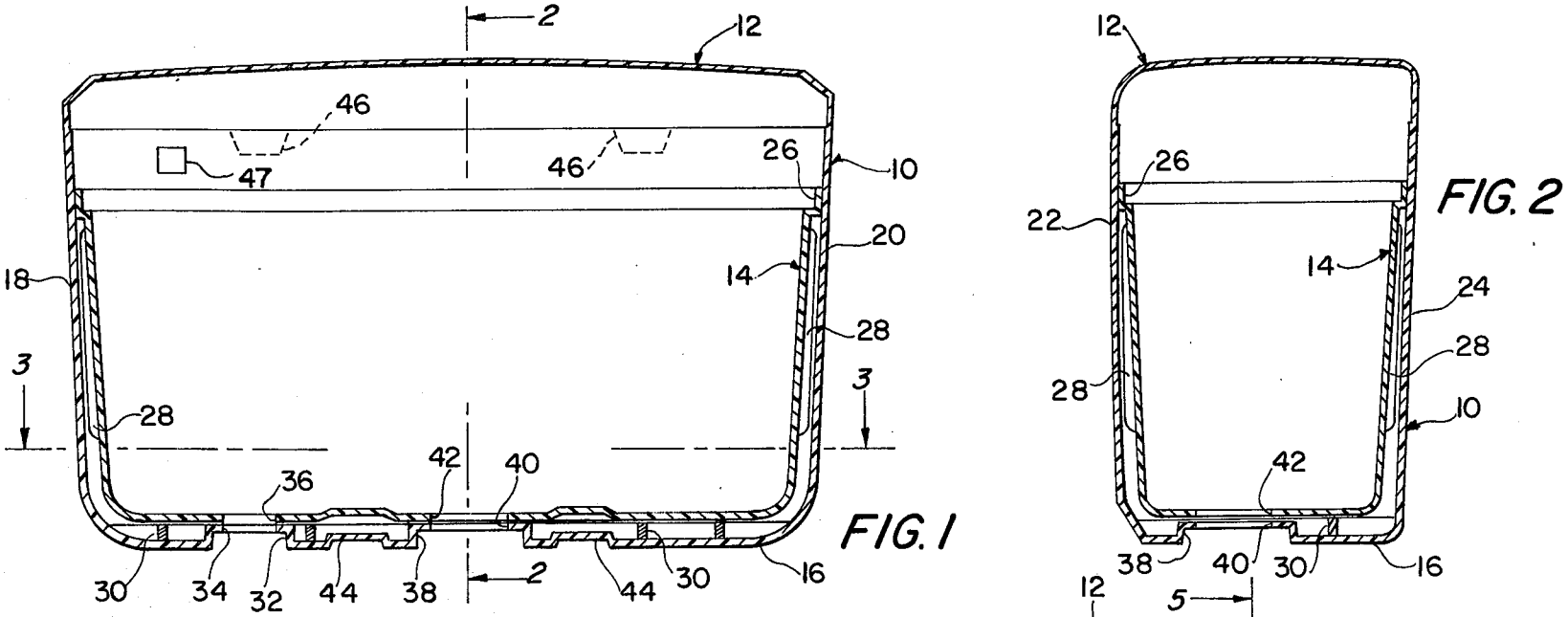
FIG. 1
FIG. 2
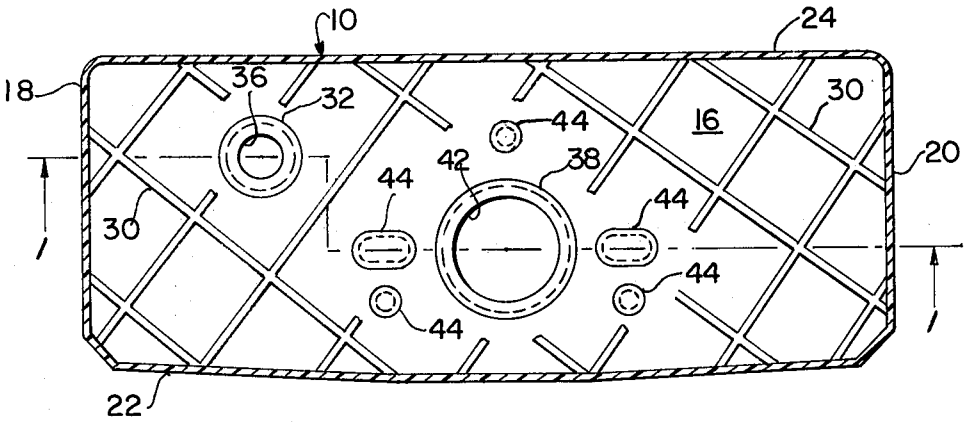
FIG. 3
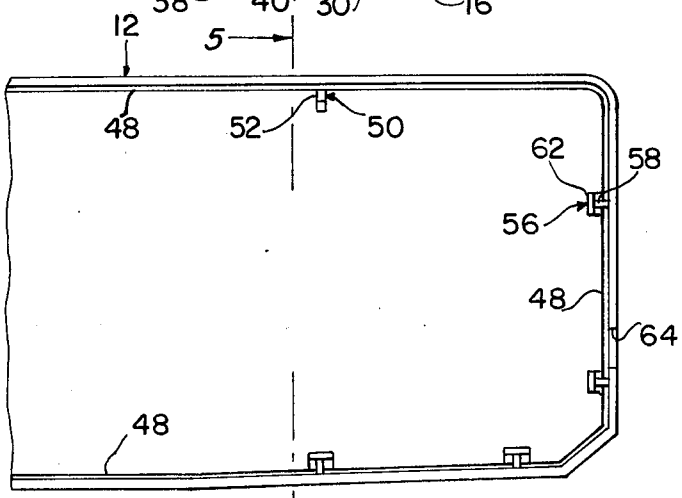
FIG. 4

WATER CLOSET TANK

BACKGROUND OF THE INVENTION

The present invention relates to a water closet tank for toilets. More specifically, the present invention relates to a water closet tank for toilets having an anti-condensation liner. Still more specifically, the present invention relates to a water closet tank and anti-condensation liner therefore formed entirely of plastics.

As is well known in the art, both the bowl and water closet tank of a toilet have heretofore been made of ceramics, such as china or porcelain. However, such structures have numerous known disadvantages. One major disadvantage is that they are heavy and cumbersome, thus making installation a major and expensive operation. Such structures are also expensive, which, together with the installation problems, makes both the initial or replacement cost an expensive proposition. These structures, particularly the water closet tank, are readily subject to breakage, cracking, crazing, discoloration and the buildup of sediment which cannot be removed. Accordingly, it is often necessary or desirable to replace the water closet tank. Since water closet tanks vary considerably in size, shape, capacity and relative position of the ball cock hole and flush valve hole, in some cases, and the bolts for mounting the tank to the bowl, replacement of the tank is a problem. Obviously, the tank must be made by the same manufacturer as the original, which is often impossible because of discontinued lines, and it is, therefore, necessary to replace both the tank and the bowl.

As is also obvious, ceramic articles and parts have often been replaced by synthetic plastic articles and parts. This is practical in many areas of use and is often an improvement, not only because of the lighter construction and reduction in cost but because synthetic plastics have such a myriad of "adjustable" properties that they can be essentially tailor-made for the particular use. For example, they can be either pliable or flexible or rigid and relatively non-pliable. However, the very advantages which make plastics desirable for many uses create problems if one wishes to use a synthetic plastic in the construction of a water closet tank for a toilet. It is known that any plastic has a lower flexural strength than ceramic and that rigid, high impactstrength plastics crack or break when flexed slightly. Accordingly, they are incapable of use as a material for water closet tanks, since such tanks must resist the force of a person leaning against them, unless they are made very thick or are profusely reinforced, thereby eliminating or reducing a number of the above-mentioned advantages.

It is also known in the art that all water closet tanks have a tendency to sweat or collect condensation on the exterior thereof, which eventually drips onto the floor. To overcome this problem, it has heretofore been proposed to provide an insulating liner for the tank. Such liners have been designed almost exclusively for existing ceramic tanks. Because of the previously-mentioned variations in size, shape, capacity and relative position of the ball cock hole, flush valve hole and mounting bolts, such structures are highly impractical and must generally be made for a specific brand and style of water closet tank. Even if a series of liners is manufactured to fit the most popular brands, it is still necessary to form at least the hole for the flush valve on the job in order to use one liner for more than one brand or line of tanks. This, of course, is a difficult and unenviable task for the plumber and will often be done inaccurately, resulting in a leaking liner. Further, if replacement of the tank is desired, the problems of installing the liner are added to the previously-mentioned problems of installing a new tank.

It is, therefore, an object of the present invention to provide a novel water closet tank which overcomes the previously-mentioned problems. Another object of the present invention is to provide a novel water closet tank with an insulating liner which overcomes the previously-mentioned problems. A further object of the present invention is to provide a novel water closet tank and such a tank with an insulating liner which is practical, inexpensive, durable, simple in construction, easily installed, lightweight, of attractive design and/or adaptable to installation on a wide variety of standard toilet bowls. Yet another object of the present invention is to provide a novel water closet tank of thin, rugged, high-impact synthetic plastic which will withstand both internal pressure (water pressure) and external pressure (a person leaning against it). Another object of the present invention is to provide a novel water closet tank having clean exterior lines unencumbered by extensions or protrusions which detract from the aesthetic appearance, make installation difficult or prevent a snug fit of an existing bowl. A further object of the present invention is to provide a rigid, high-impact strength water closet tank with a relatively more pliable liner spaced from the interior of the tank to provide an insulating air space therebetween. A further object of the present invention is to provide a water closet tank with an insulating liner of the character just described in which the water pressure in the liner forces the upper edges of the liner against the tank to form an air-tight seal between the two. Another and further object of the present invention is to provide a water closet tank with a liner spaced from the inside of the tank to form an insulating air space in which a tight, leak-proof seal can be formed when the ball cock assembly and flush valve assembly are installed and which installation binds the liner to the tank. Still another object of the present invention is to provide a novel water closet tank with an interlocking cover which reinforces and prevents flexure of the side walls of the tank. Another and further object of the present invention is to provide a novel water closet tank with an insulating liner which utilizes a significantly smaller volume of water.

These and other objects and advantages of the present invention will be apparent from the following description.

SUMMARY OF THE INVENTION

The present invention relates to an improved water closet tank for toilets comprising a generally-rectangular, opentopped tank of a relatively-thin, rigid, high-impact strength plastic, cover means for the tank of the same plastic and interlock means formed on the tank and cover to prevent relative movement of the tank and cover. The tank is also provided with a liner spaced from the inner walls of the tank and of thin plastic having a substantially greater pliability than the plastic of the tank to thereby permit flexure of the top edges of the liner outwardly against the walls of the tank by the water pressure in the liner and formation of an air-tight seal. The flexibility of the liner also results in the obtention of a water-tight seal and binding of the liner to the tank.

BRIEF DESCRIPTION OF THE DRAWINGS

FIG. 1 is a cross-sectional, front view of the water closet tank, cover and liner of the present invention;

FIG. 2 is a cross-sectional view taken along the line 2—2 of FIG. 1;

FIG. 3 is a cross-sectional view taken along the line 3—3 of FIG. 1, with the liner removed;

FIG. 4 is a partial section of the bottom of the cover structure of FIG. 1;

DETAILED DESCRIPTION OF THE PREFERRED EMBODIMENTS

Figure 5:
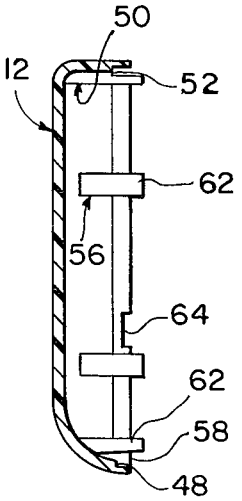
FIG. 5 is a cross-sectional view taken along the line 5—5 of FIG. 4.
Figure 6:
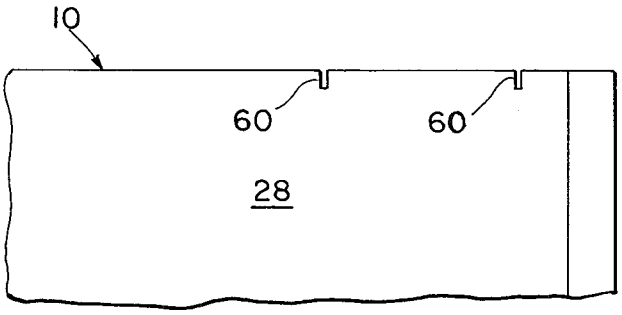
FIG. 6 is a partial section of the front of the tank of FIG. 1.

Referring now to FIGS. 1 through 3 of the drawings, the numeral 10 designates an open-topped, generally-rectangular tank, the numeral 12 a cover for tank 10 and the numeral 14 a liner for tank 10. Tank 10 has a bottom 16, end walls 18 and 20, front wall 22 and rear wall 24. Liner 14 is also generally-rectangular and has a bottom and walls generally conforming to the shape of tank 10 but smaller so as to form an annular, insulating air space between the outside of the liner 14 and the inside of the tank 10. The tank 10 and cover 12 are constructed of a thin, rigid, high impact strength plastic, such as polycarbonate or the like. The cover 12 fits on tank 10 in a manner to provide clean, unbroken design lines. Tank 10 and cover 12 are preferably formed by injection molding. Liner 14 is constructed of a thin, flexible plastic having a substantially greater pliability than the plastic of tank 10 and cover 12, such as polyethylene or the like, and is also preferably injection molded. Top rim 26 of liner 14 is offset outwardly to contact the inner walls of tank 10. The flat structure of rim 26 together with the high degree of flexibility of liner 14 cooperate to provide an air-tight seal between the top of liner 14 and tank 10 when the pressure of the water in liner 14 flexes the liner outwardly. Liner 14 is also provided with integrally-formed, vertically-disposed spacer ribs 28. Ribs 28 maintain the air space between liner 14 and tank 10, when the water in liner 14 flexes the liner outwardly and, accordingly, the peaks of ribs 28 terminate just short of the sides of tank 10 to permit some flexure of liner 14 and the consequent top sealing. Bottom 16 of tank 10 is also provided with criss-crossed, integrally-formed ribs 30. Ribs 30 maintain the air space between tank 10 and liner 14 when the liner is flexed and the peaks of ribs 30 terminate just short of the bottom of liner 14, for reasons which will be pointed out hereafter. The bottom 16 of tank 10 is provided with flattopped inward projection 32 and the top thereof is in essential contact with the bottom of liner 14. A circular aperture 34 is formed in the top of projection 32 and a corresponding aperture 36 is formed in liner 14 through which the flush valve assembly is mounted. A similar inward, flat-topped projection 38 is formed in the bottom 16 of tank 10. Projection 38 has formed therein a circular aperture 40 and liner 14 has a corresponding aperture 42 through which the ball cock assembly is mounted. Bottom 16 of tank 10 is also provided with a plurality of inward, flat-topped projections 44. Projections 44 are designed for insertion therethrough of bolts for mounting the tank to a toilet bowl. Accordingly, the tops of projections 44 are spaced from the bottom of liner 14 a distance sufficient to accommodate the heads of the bolts. While only two mounting bolts are normally necessary, the location of the bolts on standard toilet bowls varies considerably, thus a plurality of projections of varied shape are provided to make the tank usable on a wide variety of different bowls. For this purpose, the projections are also undrilled so that they can be drilled in the field to fit the requirements of the bowl mounting. Since the liner 14 is normally not sealed in tank 10 at the factory, the bolts can be locked in position, as hereinafter described, prior to installation of the liner. Preferably, however, the projections 44 are sufficiently close to the bottom of liner 14 so that the liner can be inserted first and the bolts can thereafter be locked in position in the tank by pressing downwardly on the liner 14 to hold the bolt in place during locking in position as well as during mounting on the toilet bowl. Tank 10 is also provided with vacuum breaker apertures 46 in rear wall 24 to facilitate removal of cover 12 and an aperture 47 in front wall 22 for the flush valve trip lever. It should be noted at this point that structure projections 32, 38 and 44 also result in bottom 16 having a flat, unbroken configuration with no projections, thus contributing to the aesthetic appearance as well as the ease and tightness of mounting the tank on the bowl.

The plastic used in the construction of tank 10 and cover 12 is also of a type such that it can be finished to a high gloss to match porcelain bowls and can be colored to match colored porcelain bowls.

Normally, a standard water closet tank holds about 4½ gallons of water. However, the present structure with its liner reduces this volume to about 4 gallons, thus conserving water.

As compared with standard porcelain water closet tanks, having a weight of about 35 pounds, the structure of the present invention weighs about 6 pounds.

FIGS. 4, 5, 6 and 10 illustrate the locking means of the tank 10 and cover 12. At least a portion of the lower rim of cover 12 is undercut to form a ridge 48 at least part way around the cover and, at the least, around the front and side edges. Integrally-formed along the rear rim of cover 12 are a plurality of downwardly projecting tabs 50. Tabs 50 are undercut to form shoulder 52 and slope slightly inwardly and downwardly to firmly clamp the upper lip of tank 10 between tab 50 and the reduced lower lip of cover 12. The lower lip of cover 12 and shoulder 48 match the shoulder 54 of tank 10 (FIG. 10) and lip formed thereby on the upper edge of tank 10, to thereby form a flush outer surface where cover 12 joins tank 10. Spaced about the periphery of the lower edge of the front and ends of cover 12 are generally T-shaped locking elements 56. The upright portions 58 of T elements 56 form a shoulder 58 which extends downwardly below shoulder 48 and fit into slots 40 in the upper edge of tank 10. The cross portions 42 of T elements 56 are sloped downwardly beyond the edge of cover 12 and slightly inwardly to firmly clamp the upper lip of tank 10 between portions 62 of T elements 56 and the lower lip of cover 12. It is obvious that tabs, such as 50, and T elements, such as 56, can be used exclusively all around the cover 12 or other locking means, such as slots in the upper edge of tank 10 and downwardly-projecting mating tabs on the bottom edge of cover 12, can be used. The primary factor is that the locking means of tank 10 and cover 12 locks the cover 12 on tank 10 so that the cross compressional resistance of cover 12 reinforces the top of tank 10 and prevents the tank from flexing outwardly, due to water pressure inside, and inwardly, due to one leaning against the tank. Slot 64 is formed in the edge of the lip of cover 12 for insertion of a coin or screwdriver to facilitate the removal of cover 12.

Figure 7:
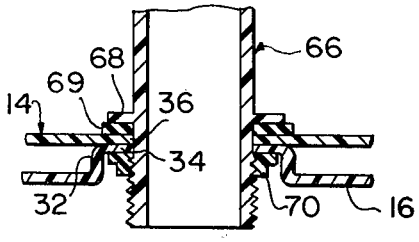
FIG. 7 is an enlarged, partial, cross-sectional view showing the mounting of the flush valve assembly in the structure of FIG. 1.
Figure 8:
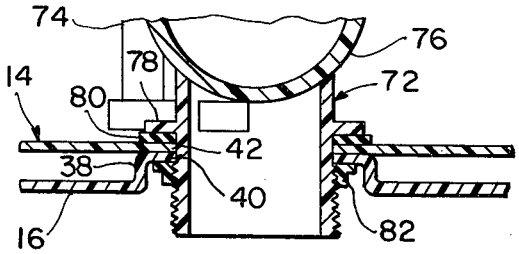
FIG. 8 is an enlarged, partial, cross-sectional view showing the mounting of the ball cock assembly in the structure of FIG. 1.

FIG. 7, shows the manner of mounting the flush valve assembly through tank bottom 16 and liner 14. Plastic pipe 66 extends through apertures 36 and 34 and is threaded on its lower end. A horizontal, annular collar 68 is formed adjacent the lower end of pipe 66 and an annular rubber gasket is placed between collar 68 and liner 14. A plastic, flush valve hex nut 70 is threaded onto the lower end of pipe 66 to compress bottom 16, liner 14 and gasket against collar 68. The flexibility of liner 14 aids in obtaining a water-tight mounting of the flush valve assembly in the structure and the mounting arrangement binds the liner 14 to the tank 10. A like arrangement is utilized to mount the ball cock assembly in tank 10 and liner 14. Plastic pipe 72 extends through apertures 40 and 42 and is threaded on its lower end. Pipe 72 is provided with a conventional overflow pipe 74 and a ball 76. A horizontal, annular collar 78 is formed adjacent the lower end of pipe 74 and an annular rubber gasket 80 is mounted between liner 14 and collar 78. A plastic ball cock nut 82 is threaded on the lower end of pipe 72. This mounting arrangement thus provides a water-tight mounting of the ball cock assembly and provides a second point of binding the liner 14 to the tank 10. A second rubber or other compressible gasket (not shown) can be placed between the liner 14 and the tank bottom 16 if desired.

Figure 9:
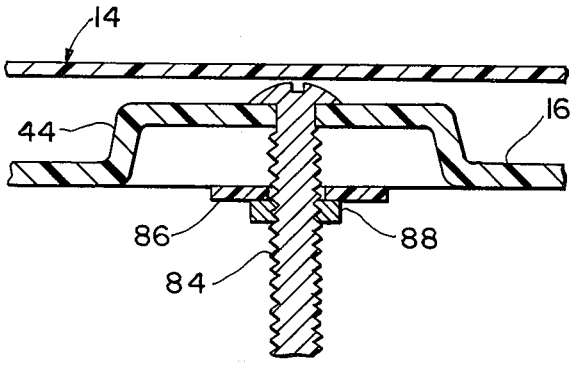
FIG. 9 is an enlarged, partial, cross-sectional view showing the mounting of bolts in the tank of FIG. 1, which in turn mount the tank on a toilet bowl.

FIG. 9 shows the manner of mounting the mounting bolts 84 in the tank bottom 16. As previously indicated, projections 44 are not drilled at the factory. Consequently, the proper projections 44 are selected and appropriately drilled in the field. Bolt 84 is then passed through the drilled hole. A plastic pad 86 spans the mouth of projection 44 and a metal nut 88 is threaded onto bolt 84. Thus, the bolt 84 is rigidly mounted in tank bottom 16. A compressible washer (not shown) can be inserted between the head of bolt 84 and the tank bottom 16 if desired. It should again be noted that the liner 14 can be flexed against the head of bolt 84 to frictionally hold the bolt during mounting in tank 10 and subsequent mounting of the tank 10 on the toilet bowl.

Figure 10:
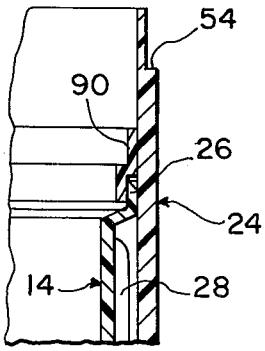
FIG. 10 is an enlarged, partial, cross-sectional view of a side wall of the tank and liner of FIG. 1 illustrating an alternate method of sealing the liner to the tank.

FIG. 10 of the drawings shows an alternate means of sealing the top of liner 14 to tank 10. In accordance with FIG. 10, a sealing ring 90 is provided which may be sealed to the inside of tank 10 and the inside of lip 26 of liner 14 with a suitable mastic.

While specific structures and alternatives have been described herein, it is to be understood that other modifications and substitutions of equivalents will be obvious to one skilled in the art and the present invention is to be limited only in accordance with the appended claims.

I claim:

1. A water closet tank for toilets, comprising: tank means formed of a thin, rigid, high-impact strength plastic, including a generally-rectangular, open-topped tank and a cover therefor; and liner means formed of a thin plastic having a substantially greater pliability than said plastic of said tank means, including a generally-rectangular, open-topped liner having overall dimensions sufficiently less than those of said tank to fit within said tank and form an air space between the bottoms and side walls of said liner and said tank and an upper rim extended outwardly and offset from the remaining portion of said liner a sufficient distance to contact the inside of said side walls of said tank, said pliability of said liner being sufficient to form a nearly air-tight seal between said upper rim of said liner and said inside of said side walls of said tank.

2. A tank in accordance with claim 1, wherein, the dimensions of the tank and the cover and the undercutting are such that a flush outer surface is presented at the juncture of said cover and said tank.

3. A tank in accordance with claim 1, wherein, both the bottom of the cover and the top of the tank are undercut to present a flush outer surface at the juncture of said cover and said tank.

4. A tank in accordance with claim 1, wherein, the bottom of the cover overlaps the top of the tank and the locking means includes a plurality of downwardly projecting tabs formed on the interior of the bottom of the cover and spaced inwardly from the inside of said bottom of said cover a distance sufficient to clamp said top of said tank between the overlapping portion of said bottom of said cover and said tabs.

5. A tank in accordance with claim 4, wherein, at least some of said tabs are generally flat and parallel to the inner wall of the cover and are spaced from and joined to said inner wall of said cover by generally flat structures perpendicular to said tabs, to thereby form a generally T-shaped structure, and a plurality of slots, equal in number to the number of said T-shaped structures, are formed in the upper edge of the tank to receive the portions of said T-shaped structures which join said tabs to said wall of said cover.

6. A tank in accordance with claim 5, wherein, the T-shaped structures and mating slots form the locking means at least along the front and sides of the tank.

7. A tank in accordance with claim 1, wherein, a horizontally-disposed slot is formed in one of the lower edge of the cover and the upper edge of the tank to receive an object to facilitate removal of said cover from said tank.

8. A tank in accordance with claim 1, wherein, at least one vacuum breaker hole is formed in one of the bottom portion of the cover and the top portion of the tank to facilitate removal of said cover from said tank.

9. A tank in accordance with claim 1, wherein, perpendicularly disposed spacer ribs are formed on one of the outside surface of the liner and the inside surface of the tank, said ribs terminating sufficiently short of the other of said outside surface of said liner and the inside surface of said tank to permit a limited amount of outward flexing of said liner.

10. A tank in accordance with claim 9, wherein, the spacer ribs are formed on the sides of the liner and on the bottom of the tank.

11. A tank in accordance with claim 1, wherein, at least two flat-topped inward projections are formed in the bottom of the tank.

12. A tank in accordance with claim 11, wherein the tops of two of the projections are in essential contact with the bottom of the liner, an aperture is formed in said top of one of said two projections and a mating aperture is formed in the liner to permit mounting of a flush valve assembly therethrough and an aperture is formed in said top of the other of said two projections and a mating aperture is formed in the liner to permit mounting of a ball cock assembly therethrough.

13. A tank in accordance with claim 12, wherein, the flush valve assembly and the ball cock assembly are constructed in a manner to clamp the peripheral edges surrounding the corresponding apertures in the projections and the apertures in the liner together and thereby provide water-tight seals and also bind said liner to the tank.

14. A tank in accordance with claim 11, wherein, the tops of at least two of the projections are spaced a sufficient distance from the bottom of the liner to accommodate the head of a bolt.

15. A tank in accordance with claim 11, wherein, the pliability of the liner and proximity of the tops of the projections to the bottom of said liner are such that downward pressure on said bottom of said liner can be applied to frictionally hold the head of the bolt during mounting of said bolt through said projection.

* * * * *